US011946180B2

(12) United States Patent
Demange et al.

(10) Patent No.: US 11,946,180 B2
(45) Date of Patent: Apr. 2, 2024

(54) NEEDLING MACHINE OR NEEDLING LINE WITH MULTI-NEEDLE BOARDS

(71) Applicant: ANDRITZ ASSELIN-THIBEAU, Elbeuf (FR)

(72) Inventors: Frédéric Demange, Elbeuf (FR); Pierre-Emmanuel Labaume, Elbeuf (FR)

(73) Assignee: Andritz Asselin-Thibeau, Elbeauf (FR)

( * ) Notice: Subject to any disclaimer, the term of this patent is extended or adjusted under 35 U.S.C. 154(b) by 190 days.

(21) Appl. No.: 17/602,094

(22) PCT Filed: Mar. 26, 2020

(86) PCT No.: PCT/EP2020/058599
§ 371 (c)(1),
(2) Date: Oct. 7, 2021

(87) PCT Pub. No.: WO2020/212113
PCT Pub. Date: Oct. 22, 2020

(65) Prior Publication Data

US 2022/0145504 A1 May 12, 2022

(30) Foreign Application Priority Data

Apr. 17, 2019 (FR) ..... 19 04119

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00; D04H 1/46; D04H 3/102; D04H 3/105; D04H 5/02;
(Continued)

(56) References Cited

U.S. PATENT DOCUMENTS 5,113,563 A * 5/1992 Feyerl ..... D04H 18/02 28/115
5,148,584 A * 9/1992 Fehrer ..... D04H 18/00 28/115

(Continued)

FOREIGN PATENT DOCUMENTS

CN 112011899 A * 12/2020 ..... D04H 18/00
DE 19615697 A1 * 3/1997 ..... D04H 18/02

(Continued)

OTHER PUBLICATIONS

International Search Report dated May 29, 2020 in related application No. PCT/EP2020/058599.

*Primary Examiner* — Amy Vanatta
(74) *Attorney, Agent, or Firm* — Renner, Kenner, Greive, Bobak, Taylor & Weber

(57) ABSTRACT

Needling machine intended to consolidate, by needling, a web of fibres, in particular a sheet of non-woven fabric, comprising a series of needle-field boards, each board having at least one respective needle field projecting from one face, called the needle face, of the board, means for making the web of fibres move in front of the needles of the boards of the series of boards and means for moving the needles back and forth in a direction transverse to the movement of the web, such that they pass through the web of fibres passing in front of them in one direction and then the other, the series of needle-field boards comprising at least a first board comprising a first needle field and a second board comprising a second needle field, the first needle field being arranged on the needle face of the first board according to a first needle face pattern and the second needle field being arranged on the needle face of the second board according to a second needle face pattern, characterised in that the first needle face pattern is such that it cannot be superimposed on its image by a 180° rotation relative to an axis parallel to the direction of the needles and/or of movement of the needles, and the second needle face pattern is identical to the first needle face pattern, but is rotated by 180° relative thereto, relative to an axis parallel to the direction of the needles and/or of movement of the needles.

7 Claims, 4 Drawing Sheets

(58) Field of Classification Search
CPC ..... D04H 13/005; D05C 15/12; D05C 15/26; D05C 15/10; D05C 3/02
USPC ..... 28/115, 107, 109, 111
See application file for complete search history.

(56) References Cited

U.S. PATENT DOCUMENTS

| | | | | |
|---|---|---|---|---|
| 6,305,058 | B1 * | 10/2001 | Fehrer | D04H 18/02 28/107 |
| 2010/0162543 | A1 * | 7/2010 | Dilo | D04H 18/02 28/115 |
| 2017/0130381 | A1 * | 5/2017 | Knopf | D04H 18/02 |
| 2018/0257331 | A1 * | 9/2018 | Evrard | D04H 3/105 |
| 2020/0378045 | A1 * | 12/2020 | Dilo | D04H 18/02 |

FOREIGN PATENT DOCUMENTS

| | | | | |
|---|---|---|---|---|
| EP | 1055760 | A1 * | 11/2000 | B60N 3/048 |
| EP | 3372718 | A1 | 9/2018 | |
| FR | 2657095 | A1 | 7/1991 | |
| FR | 2878262 | A1 | 11/2004 | |
| FR | 3026113 | A1 | 9/2014 | |
| WO | WO-2006056675 | A1 * | 6/2006 | D04H 11/08 |
| WO | WO-2011045691 | A1 * | 4/2011 | D04H 18/02 |

* cited by examiner

[Fig. 1]
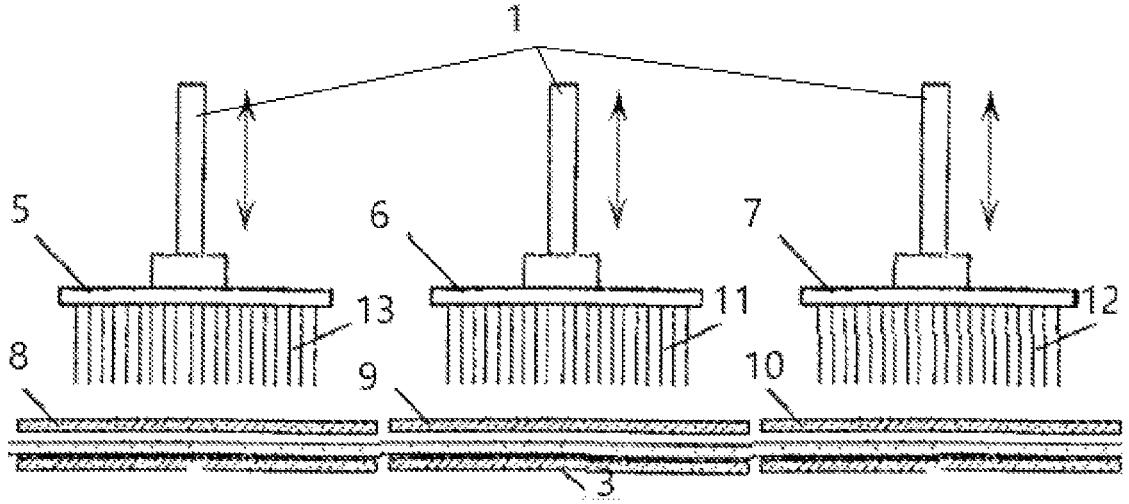
[Fig. 2]
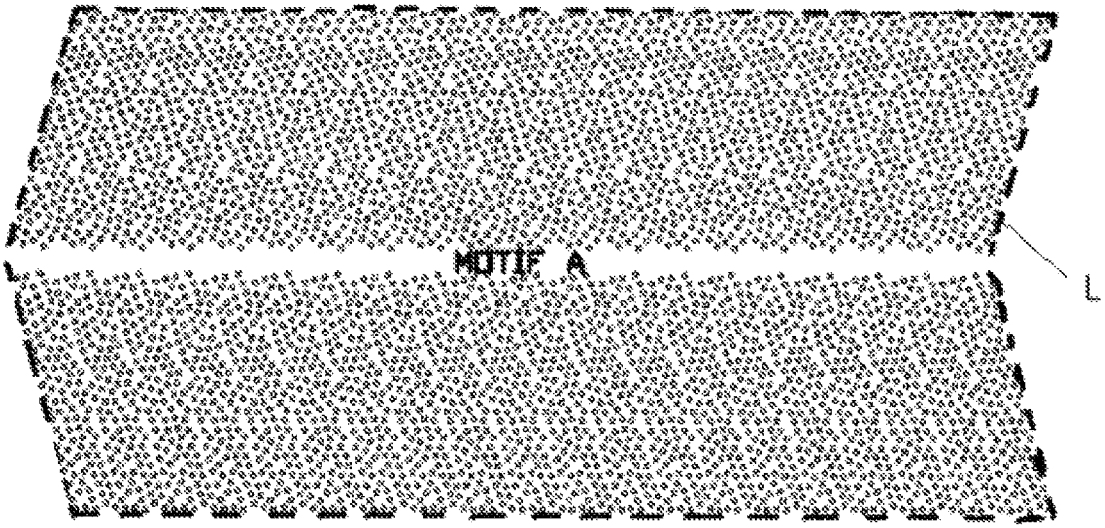
PATTERN A

[Fig. 3]
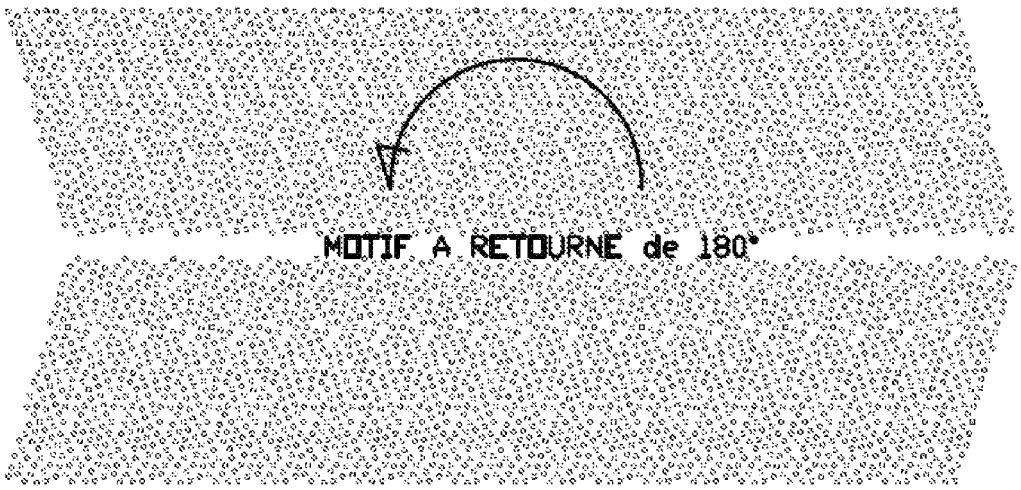
PATTERN ROTATED by 180°
[Fig. 4A]
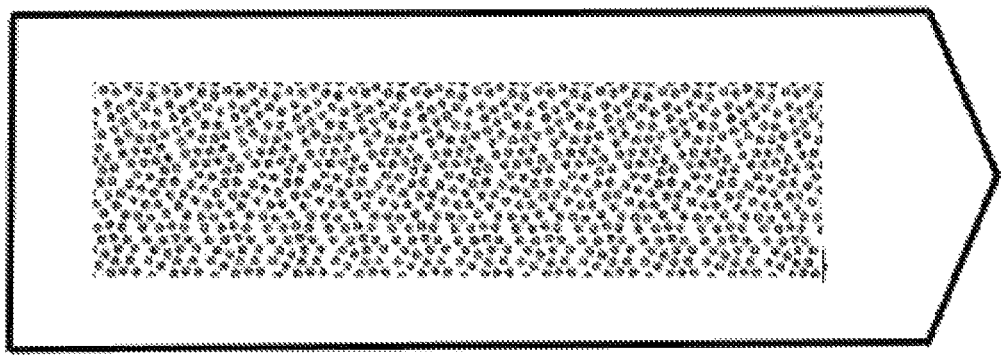

[Fig. 4B]
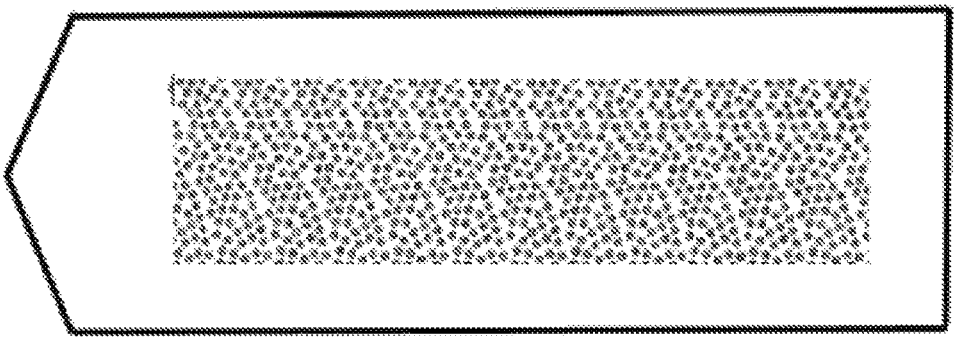
[Fig. 5]
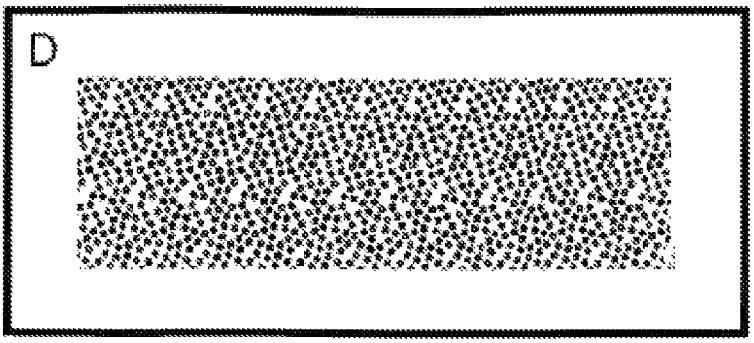
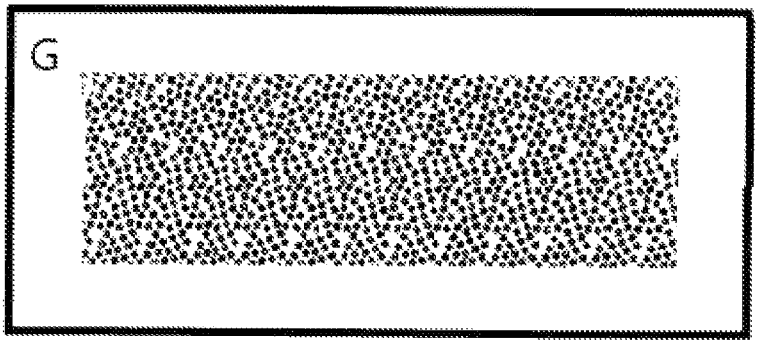

[Fig. 6]
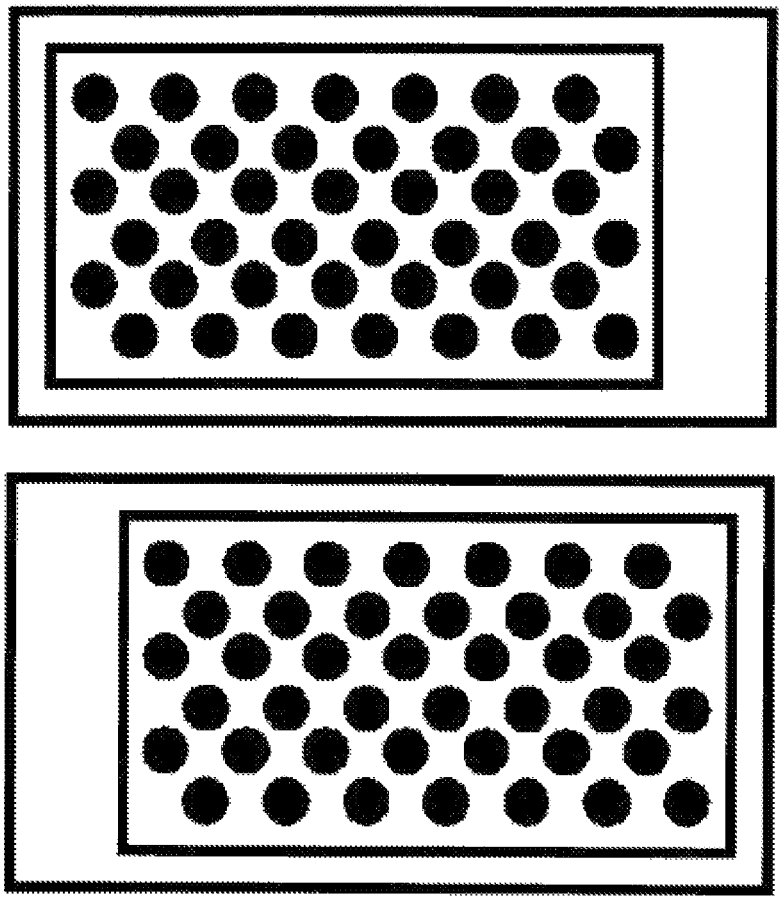

NEEDLING MACHINE OR NEEDLING LINE WITH MULTI-NEEDLE BOARDS

TECHNICAL FIELD

The present invention relates to a needling device, or needling machine, intended to consolidate by needling a web of fibres, in particular a sheet of non-woven fabric.

BACKGROUND

A needling device classically comprising means for passing a web of fibres, for example a sheet of non-woven fabric, in front of at least one needle field, in particular a series of needle fields, means for making the needles move back and forth in a direction essentially perpendicular to the plane of the web passing in front of them thereby consolidating the web.

Classically, each needle-field board is formed on one face of a board, called a needle-field board, the needles being positioned on the board in a needle face pattern such that the needles are not perfectly aligned in the direction of movement of the web of fibres such that the downstream needles do not strike the web in the same place as the needles struck upstream thereby creating so-called alignment faults in the web leaving the needling machine.

Classically, it is well known that to avoid such alignment faults, the needle boards should be given uniform but random or pseudo random distribution patterns on the board, that is that the patterns in which there are a large number N of needles giving the impression, on simple visual inspection, of being distributed essentially uniformly, in particular in the form of rows and columns, but which are in fact distributed irregularly, and in particular distributed randomly or quasi-randomly, with a bias to avoid the appearance of alignment and other faults in the web of fibres.

The problem with known patterns of this type is firstly that they are time-consuming and tedious to manufacture, owing to the random nature of the pattern. Secondly, it is current practice to use a series of needle boards with the same pattern on the same machine, which can periodically cause alignment faults to appear on the web leaving the device, making it necessary to manufacture several different patterns, further increasing the manufacturing time and the tedious nature of the process which also leads to the risk of error when fitting them.

SUMMARY OF THE INVENTION

The aim of the present invention is to overcome the problems of earlier technology by proposing a needling machine with a structure that is simpler to manufacture and yet results in a web of fibres leaving the machine that no longer has alignment faults as with devices of earlier technology, or at least has fewer.

According to the invention, a needling machine designed to consolidate a web of fibres, in particular a sheet of non-woven fabric, by needling comprises a series of needle boards, each board having a respective field of needles projecting from one face, called the needle face, of the board, means for moving the web of fibres in front of the needles on the boards of a series of boards and means for moving the needles back and forth in a direction transverse, in particular perpendicular, to the movement of the web, so that the latter traverse the web of fibres passing in front of them in one direction, then the other, the series of needle field boards comprising at least a first board and a second board comprising a second needle field, the first needle field being arranged on the needle face of the first board according to a first needle face pattern and the second needle field being arranged on the needle face of the second board according to a second needle face pattern, characterised in that the first needle face pattern is such that it cannot be superimposed on its image by a rotation of 180° relative to an axis parallel to the direction of the needles and/or the movement of the needles, and the second needle face pattern is identical to the first needle face pattern, but rotated by 180° thereto, relative to an axis parallel to the direction of the needles and/or the movement of the needles.

Thus by using the same pattern for two needle board faces in successive needle fields, in particular two, one following the other directly in the series, but by rotating one relative to the other, we obtain the advantage of always having, with respect to the product, different patterns thereby maintaining the quality of the product leaving the needling machine and also simplifying the manufacture of the patterns, one pattern being used for two fields, which reduces the diversity of patterns to be manufactured.

According to a preferred method of implementation of the invention, the first and second fields have needle field patterns called random or pseudo random.

According to a preferred method of implementation of the invention, the first and second needle fields are formed on respective boards of the same shape, the shape being such that a distinction can be made between one board and the same board rotated 180° relative to an axis parallel to the direction of the needles and/or the movement of the needles, for example by having a non-symmetrical sign or mark, that is to say that it cannot be superimposed on its image by a rotation of 180° relative to an axis parallel to the direction of the needles and/or the movement of the needles, for example an arrow defining a direction, so that the user can easily see in which direction one board has been placed relative to the other board in the series of boards and so can position the second board rotated by 180° relative to the first board.

According to another preferred method of implementation, the first and second needle fields are formed on the first and second respective boards having, apart from the needle fields, first and second respective shapes that are different from each other, for example comprising different respective signs or marks, so that the user can easily see in which direction the first needle field is arranged relative to the second needle field in the series of boards and so can easily position the second needle field rotated by 180° relative to the first needle field.

In fact, when viewing the two random or pseudo random field patterns of the two successive needle fields, it is not easy for the user to distinguish whether the two fields have been reversed (by rotation by 180°) or not. By looking at the non-symmetrical arrow or sign, whose function can also be performed by the shape of the outline of the needle face of the board or of the boundary line of the needle field or by the position, for example off-centre, of the needle fields on the face of the board, the user can easily ensure that the two fields have actually been reversed.

The present invention also relates to a web of fibres, in particular non-woven fabric, consolidated by passing through a needling machine according to the invention.

The present invention also relates to a series of at least two needling machines designed to consolidate a web of fibres, in particular a sheet of non-woven fabric, by needling, each needling machine comprising a series of needle field boards, each board having a respective needle field projecting from a needle face of the board, means for moving the web of fibres in front of the needles of the boards in the series of boards and means for moving the needles back and forth in a direction transverse to the movement of the web, to so that the latter traverse the web of fibres in one direction, then in the other passing in front of them, characterised in that one of the board(s) with one or more respective needle face patterns is arranged on one of the needling machines and one of the boards with the respective needle pattern rotated by 180° is arranged on the other of the at least two needling machines.

The present invention also relates to a needling machine characterised additionally in that each board bears a non-symmetrical sign or mark, that is to say that it cannot be superimposed on its image by a rotation of 180° relative to an axis parallel to the direction of the needles and/or the movement of the needles, for example an arrow defining a direction, so that the user can easily see in which direction the board has been placed relative to the other board in the series of boards and thus position the second board rotated by 180° relative to the first board.

The present invention also relates to a needle board designed to form part of a needling machine, the needle field projecting from one needle face of the board being arranged according to a needle face pattern that cannot be superimposed on its image by a rotation of 180° relative to an axis parallel to the direction of the needles and/or the movement of the needles characterised in that the shape of the board and/or the boundary line and/or the position of the needle field, for example off-centre, of the needle field on the needle face of the board enables a distinction to be made between the board and the same board rotated by 180° relative to an axis parallel to the direction of the needles and/or the movement of the needles.

The present invention also relates to a set of needle boards for a needling machine comprising at least a first board and a second board, a first needle field projecting from a needle face of the first board and a second needle field projecting from a needle face of the second board, the two needle faces forming a respective identical needle face pattern, while the two boards have different shapes from each other, apart from the needle field, in particular each bearing a different sign.

BRIEF DESCRIPTION OF THE DRAWINGS

As an example, preferred methods of implementation of the invention are described with reference to the drawings, in which:

FIG. 1 is a side view of a needling machine according to the invention, comprising three needle boards in series;

FIG. 2 is a view from below (on the needle side) of the intermediate needle board of the needling machine in FIG. 1, FIG. 3 is a view from below of the third needle board of the needling machine in FIG. 1, FIG. 4A is a view from below of a needle board according to another method of implementation of the invention;

FIG. 4B is a view from below of the needle board in FIG. 4A rotated by 180°;

FIG. 5 is a view from below of a set of two needle boards according to the invention; and FIG. 6 is a view from below of a series of the same board according to yet another method of implementation according to the invention, in which the needle field pattern of the board is symmetrical, but the needle face pattern is not, the board being shown, in the series, at the top of the diagram, in one direction, and at the bottom of the diagram, rotated by 180°.

DETAILED DESCRIPTION OF THE INVENTION

FIG. 1 shows a needling machine 1 comprising a supporting table 3, which may include brushes, over which a web of fibres passes, in particular a web of non-woven fabric, which it is desired to consolidate by traversing with needles 11, 12, 13 projecting from the needle boards 5, 6 and 7 the first arranged following the others in the direction of movement of the web over it. Strippers 8, 9 and 10 can also be provided between each board and the web to be consolidated, each stripper being drilled with a field of through holes in an identical pattern to the needle field of its associated board, so that the needles pass first through the stripper at the top and pierce the web from above then pass through the stripper again at the bottom after piercing the web, the stripper thus preventing fibres of the web from becoming entangled with the needles, any entangled fibres being stopped by the lower edge of the holes in the stripper and prevented from continuing their upward movement with the needles.

Needle boards 5, 6 and 7 are arranged in rows, one following another in the direction of movement of the web of fibres. The needle boards have, by classical methods of control, a vertical back and forth movement to permit the needles to traverse the web from top to bottom, then from bottom to top thereby consolidating the non-woven fabric. The arrangement of the needles on their respective board follows patterns, that is firstly a needle field pattern defining the arrangement of the needles with respect to each other in the needle field, and secondly a needle face pattern, this needle face pattern, including firstly the needle field pattern, and secondly the needle-free zones in the face of the board from which the needles project, this face, classically essentially rectangular in shape, being described hereinafter as the needle face.

The needle boards 11 in the needle field projecting from a needle face of the intermediate board are arranged according to a first pattern A of a given needle field which is shown in FIG. 2. This pattern is called random or quasi random but is essentially uniform, that is to say that to the naked eye, it gives an impression of uniformity. Pattern A is a non-symmetrical pattern, that is to say it cannot be superimposed on or identical to its image obtained by a rotation of 180° in relative to an axis parallel to the direction of the needles and/or the movement of the needles, and in particular cannot be superimposed on itself.

The needles 12 of the needle field projecting from one needle face of the third or last board 7 are arranged according to a second given needle field pattern B which is shown in FIG. 3. This pattern is called random or quasi random but is essentially uniform, that is to say that to the naked eye it gives an impression of uniformity. This second pattern B is non-symmetrical, that is to say it is not identical to its image obtained by a rotation of 180° relative to an axis parallel to the direction of the needles and/or the movement of the needles, and in particular cannot be superimposed on itself. Furthermore, the second pattern B is identical to the first pattern A, but rotated 180° relative to the pattern A before being positioned following the pattern A in the direction MD of the needling machine. In particular, if one or other of the two patterns A and B is superimposed on its respective image obtained by a rotation of 180° relative to an axis parallel to the direction of the needles and/or the movement of the needles, less than 50% of the needles, preferably, less than 40%, even more preferably less than 30%, in particular less than 20%, even more particularly less than 10%, for example less than 5%, or even better less than 1% of the needles of a pattern are directly opposite a needle of its image.

The needle field pattern A in FIG. 2 covers the whole of the needle face of board 6, such that in the method of implementation in FIG. 2, needle field pattern A and the needle face pattern of board 6 are identical.

Similarly, needle field pattern B in FIG. 3 covers the whole of the needle face of board 7, such that in the method of implementation of FIG. 2, needle field pattern B and the needle face pattern of board 7 are identical.

According to the invention, random or quasi random means a needle field pattern containing a large number of needles in which a sub-pattern with 3, 5 or 7 needles which repeats contiguously in the pattern cannot be determined, that is to say each sub pattern is adjacent to the following sub-pattern in the series. Two sub patterns are contiguous when there is a pair of needles of which one forms a part of one of the two sub patterns and the other of the two sub patterns, and the two needles of the pair of needles are not separated by any needle between them.

The second pattern B corresponds to the first pattern A rotated by 180° relative to an axis perpendicular to the direction MD and the direction CD, that is to say perpendicular to the plane of the web and parallel to the direction of the needles and/or the movement of the needles.

As can be seen in FIGS. 2 and 3, boards 6 and 7 have identical surrounding edges, but they have been rotated 180° with respect to each other. Therefore the user, when positioning the two boards 6 and 7 in the needling machine, is capable, based on the shape of their edge, of positioning one in one direction and the other in the other without careful regard to the shape of the pattern, knowing that since the two patterns are identical, but rotated with respect to each other, both called random, on simple visual inspection, it is difficult to distinguish one from the other by their respective orientation.

According to the invention, to define a needle field projecting from a board, the boundary line of the field is defined as being the closed line passing through the base of the outermost needles, so that all the needles lie within this closed line, and the needle field is defined as being the area enclosed by this closed line. For example, in FIG. 2, the boundary line L is shown as a dashed line. In FIG. 2, this line also corresponds to the boundary line of the needle face of the board.

FIG. 4A shows a method of implementation of a board according to the invention. A needle field projects from the board forming a pattern of needles. Furthermore, apart from the needle field, the needle face comprises regions without needles surrounding the needle field. A needle pattern on the face of the board is thus defined that encapsulates the needle field pattern and the regions without needles. The board has one edge with two mutually parallel long sides linked on one side by a straight line and on the other side by two straight line segments forming an angle between them pointing to the right in FIG. 4A.

FIG. 4B, shows the board in FIG. 4A rotated by 180°. The angled side thus points to the left in the diagram. Regarding the needle field and the needle face patterns, projecting from the board respectively, they are also rotated 180°. If the two patterns in FIGS. 4A and 4B are superimposed, even though they are identical, neither the needle field pattern nor the needle face pattern match. The arrow shape tells the user that the needle pattern field in FIG. 4B is rotated by 180° with respect to that in FIG. 4A.

FIG. 5 shows a pair of needle boards according to another method of implementation of the invention. The needle field pattern of the board bearing the sign D is not symmetrical. Similarly, the needle field pattern of this board is not symmetrical. However, neglecting the needle field pattern, the rest of the needle face pattern, that is the regions without needles, is symmetrical. As the needle field pattern is a random pattern with a large number of needles, it is difficult for the user to know in which direction it lies. Therefore, without the presence of the letter D, it would be very difficult for him to distinguish between that board and the same board rotated by 180°.

The needle field pattern and the needle face pattern of the board bearing the sign G are identical to those of the board bearing the sign D, however, if the two boards are considered to be oriented in the direction in which the two letters D and G are in the normal direction of reading (as shown in the diagram), they are rotated by 180° with respect to those of the board bearing the sign D.

FIG. 6 shows another method of implementation of a board according to the invention. Here, the needle field pattern is a needle field pattern bounded by a rectangle offset to the left with respect to the centre of the needle face of the board. When rotated by 180°, this rectangle is offset to the right with respect to the centre.

The needle field pattern within the small offset rectangle is symmetrical. That is to say when it is rotated by 180° (the lower board in the diagram), it is identical or superimposable on itself.

On the other hand, due to the offsetting of the needle field pattern with respect to the centre of the needle face of the board, the needle face pattern is not symmetrical, and cannot be superimposed on itself.

The result of this is that when the two boards are positioned as in the diagram, one following the other, the needles do not strike the non-woven fabric in the same place and the effect of the invention on the quality of the non-woven fabric is also obtained in this method of implementation with a symmetrical needle field pattern. Similarly, owing to the non-symmetrical shape of the needle face pattern of the board, it is easy for the user to position the same board twice afterwards, with one reversed with respect to the other, even though the board has a symmetrical shape, apart from the needle field.

The first board may be a board with an identical pattern to that of one of the other two boards or a different pattern, in particular a less dense needle pattern 13 corresponding to an induction or input region of the web into the needling machine; The first board need not be provided and thus there are only the two boards 6 and 7. On the other hand there can be more than three needle boards. Neither need the two patterns rotated by 180° one following the other, be provided, but conversely they may be separated with boards placed between them. Furthermore, the invention could also be operated in the case where rising boards and not falling boards are fitted as in the example, or in the case where several rising boards and several falling boards are fitted at the same time, the invention can be operated equally well with rising or falling boards or both at once. Furthermore, the invention can also be operated in the case where a series of several needling machines is provided or alternatively boards can be arranged with patterns on one of the machines and boards with the patterns rotated by 180° on another machine.

The invention claimed is:

1. Needling machine intended to consolidate a web of fibres, comprising a series of needle-field boards, each needle-field board having a least one respective needle field projecting from a needle face of the needle-field board, the web of fibres being movable in front of the at least one respective needle of the series of needle-field boards, and needles of the at least one respective needle field being movable back and forth in a direction transverse to the movement of the web, so that the needles traverse the web of fibres in one direction, then in the other, wherein the series of needle-field boards comprise a first board including a first needle field and a second board including a second needle field, the first needle field being arranged on the needle face of the first board according to a first needle face pattern and the second needle field being arranged on the needle face of the second board according to a second needle face pattern, characterised in that the first needle face pattern is such that it cannot be superimposed on its image by a rotation of 180° with respect to an axis parallel to the direction of the needles and/or the movement of the needles, and the second needle face pattern is identical to the first needle fact face pattern rotated by 180° with respect to an axis parallel to the direction of the needles and/or the movement of the needles.

2. Needling machine according to claim 1, characterised in that the first and second needle fields are placed one immediately after the other.

3. Needling machine according to claim 1, characterised in that the first and second needle fields have needle field patterns that are random or pseudo random patterns.

4. Needling machine according to claim 1, characterised in that the first and second needle-field boards have an identical shape, such that a distinction can be made between the first needle-field board and the second needle-field board rotated by 180° with respect to an axis parallel to the direction of the needles and or the movement of the needles.

5. Needling machine according to claim 1, characterised in that the first and second needle-field boards have first and second respective shapes differing from each other so that the user can easily see in which direction the first needle field is placed with respect to the second needle field in the series of boards and thus can easily position the second needle field rotated by 180° with respect to the first needle field.

6. Needling machine according to claim 1, characterised in that each of the first and second needle-field boards bears a non-symmetrical sign or mark, that it is not identical or superimposable on its image by rotation of the non-symmetrical sign or mark by 180° with respect to an axis parallel to the direction of the needles and/or the movement of the needles, so that the user can easily see in which direction the first needle-field board has been placed with respect to the second needle-field board in the series of boards and thus position the second needle-field board rotated by 180° with respect to the first needle-field board.

7. Needling machine according to claim 6, characterised in that the non-symmetrical sign or mark consists of a boundary line of the needle field.

* * * * *